US011598104B2

(12) United States Patent
Volponi

(10) Patent No.: US 11,598,104 B2
(45) **Date of Patent: *Mar. 7, 2023**

(54) SYSTEM AND METHOD FOR ALIGNING AND LEVELING TILE

(71) Applicant: New Standards Manufacturing Co., Keokuk, IA (US)

(72) Inventor: Michele Volponi, Keokuk, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/871,421

(22) Filed: May 11, 2020

(65) Prior Publication Data

US 2020/0270870 A1 Aug. 27, 2020

Related U.S. Application Data

(60) Continuation of application No. 15/275,958, filed on Sep. 26, 2016, now Pat. No. 10,648,181, which is a (Continued)

(51) Int. Cl.
*E04F 13/08* (2006.01)
*E04F 21/18* (2006.01)
(Continued)

(52) U.S. Cl.
CPC ..... *E04F 13/0892* (2013.01); *E04F 13/0889* (2013.01); *E04F 15/0215* (2013.01); (Continued)

(58) Field of Classification Search
CPC ..... E04F 13/0892; E04F 21/0092; E04F 21/1877; E04F 21/20; E04F 21/22
(Continued)

(56) References Cited

U.S. PATENT DOCUMENTS 1,918,228 A 7/1933 Spencer
2,277,892 A 3/1942 Swenson
(Continued)

FOREIGN PATENT DOCUMENTS

CA 2847571 A1 3/2013
CA 2881270 A1 2/2014
(Continued)

OTHER PUBLICATIONS

Kufner et al., The Lippage-Free Tile System, Web (www.tuscanleveling.com), 2006, Fairfield, IA.

*Primary Examiner* — Robert Canfield
(74) *Attorney, Agent, or Firm* — Simmons Perrine Moyer Bergman PLC

(57) ABSTRACT

A tile aligning and leveling system that uses an under tile base re-usable upright connecting tab, which is detachably connected to said under tile base, a re-usable flexible edge slotted cap configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

20 Claims, 5 Drawing Sheets

Related U.S. Application Data continuation of application No. 14/186,729, filed on Feb. 21, 2014, now Pat. No. 9,945,133, which is a division of application No. 14/030,346, filed on Sep. 18, 2013, now Pat. No. 8,689,521, which is a division of application No. 13/855,537, filed on Apr. 2, 2013, now Pat. No. 8,561,370, which is a division of application No. 13/707,369, filed on Dec. 6, 2012, now Pat. No. 8,572,927, which is a division of application No. 13/296,737, filed on Nov. 15, 2011, now Pat. No. 8,429,878.

(51) Int. Cl.

| | |
|---|---|
| ***E04F 21/20*** | (2006.01) |
| ***E04F 21/00*** | (2006.01) |
| ***E04F 21/22*** | (2006.01) |
| ***E04F 15/02*** | (2006.01) |

(52) U.S. Cl.

CPC ..... *E04F 21/0092* (2013.01); *E04F 21/1877* (2013.01); *E04F 21/20* (2013.01); *E04F 21/22* (2013.01); *Y10T 29/53796* (2015.01)

(58) Field of Classification Search

USPC ..... 52/126.1, 126.5, 466, 468, 471, 472, 52/749.11; 33/613, 645

See application file for complete search history.

(56) References Cited

U.S. PATENT DOCUMENTS 3,254,361 A * 6/1966 Craven ..... A47G 27/0462 16/16
3,303,626 A * 2/1967 Brigham ..... E04C 2/384 52/717.05
3,511,001 A 5/1970 Morgan
3,688,460 A * 9/1972 Van Loghem ..... E04F 19/062 52/466
3,861,098 A 1/1975 Schaub
3,961,453 A 6/1976 Couwenbergs
4,024,683 A 5/1977 Kilian
4,067,155 A * 1/1978 Ruff ..... E04B 1/6803 4/498
4,397,125 A 8/1983 Gussler
4,503,654 A 3/1985 Cosentino
4,583,343 A 4/1986 Camp
4,744,194 A 5/1988 Yasuyoshi
4,862,668 A 9/1989 DeGooyer
5,155,952 A * 10/1992 Herwegh ..... E04B 1/6803 52/100
5,345,990 A 9/1994 Potts
5,350,399 A 9/1994 Erlebacher et al.
5,603,195 A 2/1997 Cosentino
5,675,942 A 10/1997 Crawford
5,843,546 A 12/1998 Eichhorn
6,022,351 A 2/2000 Bremer et al.
6,253,515 B1 7/2001 Kuelker
6,588,165 B1 * 7/2003 Wright ..... E04F 19/06 52/459
6,625,951 B1 9/2003 McCarthy
6,631,594 B2 * 10/2003 Whiting ..... E04B 7/063 52/204.5
6,711,870 B1 * 3/2004 Richardson ..... E04D 3/08 52/775
6,755,834 B2 6/2004 Amis
7,257,926 B1 8/2007 Kirby
D552,266 S 10/2007 Murdock
7,621,100 B2 11/2009 Kufner et al.
D621,966 S 8/2010 Vaes et al.
D630,077 S 1/2011 Kufner et al.
D630,078 S 1/2011 Kufner et al.
7,861,487 B2 1/2011 Kufner et al.
7,895,802 B2 * 3/2011 Kurz ..... E04F 19/062 52/468
7,946,093 B1 5/2011 Sturino
D640,119 S 6/2011 Kufner et al.
7,954,300 B1 6/2011 Kufner et al.
7,992,354 B2 8/2011 Doda
8,079,199 B1 12/2011 Kufner et al.
8,099,921 B2 * 1/2012 Muehlebach ..... E04F 19/067 52/468
D658,963 S 5/2012 Kufner et al.
8,181,420 B2 5/2012 Comas
8,241,342 B2 8/2012 Kirschman
8,245,465 B2 * 8/2012 Bai ..... E06B 3/5427 52/235
8,429,787 B2 4/2013 Maynard et al.
8,429,878 B1 4/2013 Hoffman et al.
8,429,879 B1 4/2013 Hoffman et al.
8,607,468 B2 12/2013 Hillebrandt
8,628,049 B2 1/2014 Ghatikar
8,646,237 B1 * 2/2014 Takagi ..... E04B 1/7629 52/464
8,689,522 B2 4/2014 Hoffman et al.
8,800,246 B2 8/2014 Gorton
8,966,835 B1 * 3/2015 Hoffman ..... E04F 21/0092 52/126.1
9,010,064 B1 4/2015 Farahmandpour
9,027,308 B2 5/2015 Kufner et al.
9,045,911 B2 6/2015 Hoffman et al.
9,097,026 B2 8/2015 Hoffman et al.
9,149,276 B2 10/2015 Voss
9,228,363 B2 1/2016 Kufner et al.
9,267,297 B2 2/2016 Zinßler
9,279,259 B1 3/2016 Russo
9,322,185 B1 4/2016 Russo
9,353,515 B2 5/2016 Farahmandpour
9,433,438 B2 9/2016 Memmolo et al.
9,464,448 B2 10/2016 Hoffman et al.
9,540,804 B1 * 1/2017 Farahmandpour .. E04F 13/0826
9,657,485 B2 5/2017 Meyers
10,161,145 B2 12/2018 Florensa et al.
10,934,723 B2 * 3/2021 Castellanos ..... E04F 21/0092
2002/0000072 A1 * 1/2002 McGrath ..... F16B 5/0642 52/466
2003/0229349 A1 12/2003 Wellisz et al.
2006/0185269 A1 8/2006 Kufner et al.
2006/0185319 A1 8/2006 Kufner et al.
2007/0039273 A1 * 2/2007 Richardson ..... E04D 3/08 52/466
2007/0214743 A1 9/2007 Alvarez
2008/0141617 A1 6/2008 Joski
2008/0236094 A1 10/2008 Doda
2008/0275511 A1 11/2008 Weinacker et al.
2010/0263304 A1 10/2010 Comas
2010/0287868 A1 11/2010 Kufner et al.
2011/0011031 A1 1/2011 Kufner et al.
2011/0265424 A1 11/2011 Kufner et al.
2012/0085066 A1 4/2012 Kufner et al.
2012/0144773 A1 6/2012 Mauro
2013/0055675 A1 3/2013 Sighinolfi
2013/0067854 A1 3/2013 Bordin
2013/0074425 A1 3/2013 Miyamoto
2013/0118115 A1 5/2013 Hoffman et al.
2013/0247508 A1 9/2013 Hoffman et al.
2013/0255182 A1 10/2013 Kufner et al.
2014/0116001 A1 5/2014 Ghelfi
2014/0223755 A1 8/2014 Madrack
2014/0283401 A1 9/2014 Kufner et al.
2014/0298736 A1 10/2014 Bunch et al.
2014/0325935 A1 11/2014 Hoffman et al.
2014/0325936 A1 11/2014 Psaila et al.
2015/0027082 A1 1/2015 Hoffman et al.
2015/0113895 A1 4/2015 Zinßler
2015/0211243 A1 7/2015 Irvine et al.
2015/0308130 A1 10/2015 Biec
2015/0337546 A1 11/2015 Hoffman et al.
2016/0053501 A1 2/2016 Comas
2016/0348381 A1 12/2016 Meyers

(56) References Cited

U.S. PATENT DOCUMENTS

| | | | | |
|---|---|---|---|---|
| 2018/0291640 | A1 | 10/2018 | Sighinolfi et al. | |
| 2020/0240154 | A1 * | 7/2020 | Nudo | E04F 21/1877 |

FOREIGN PATENT DOCUMENTS

| | | | | | |
|---|---|---|---|---|---|
| CA | 3013641 | A1 | | 8/2017 | |
| CN | 110374300 | B | * | 7/2021 | |
| DE | 2301169 | A1 | | 7/1974 | |
| EP | 244349 | A2 | * | 11/1987 | |
| EP | 3533951 | B1 | * | 2/2021 | |
| EP | 245981 | B1 | * | 6/2021 | |
| GB | 2460429 | A | | 12/2009 | |
| JP | 07305494 | A | | 11/1995 | |
| WO | PCTUS2012055482 | | | 9/2012 | |
| WO | WO-2016196423 | A1 | * | 12/2016 | E04F 21/1877 |
| WO | WO-2016201502 | A1 | * | 12/2016 | E04F 21/22 |

* cited by examiner

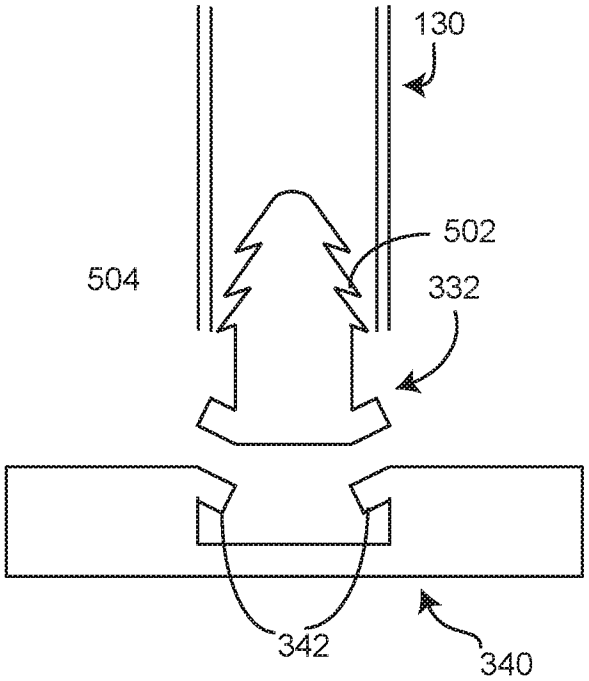
FIG. 6
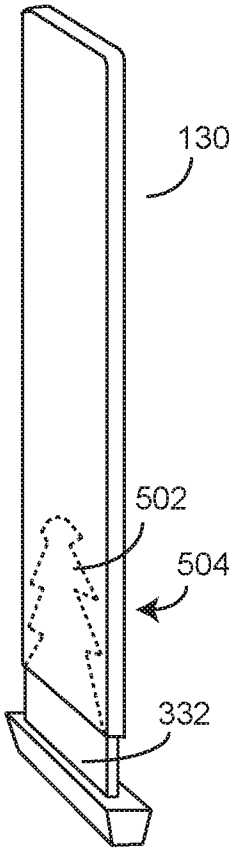
FIG. 5
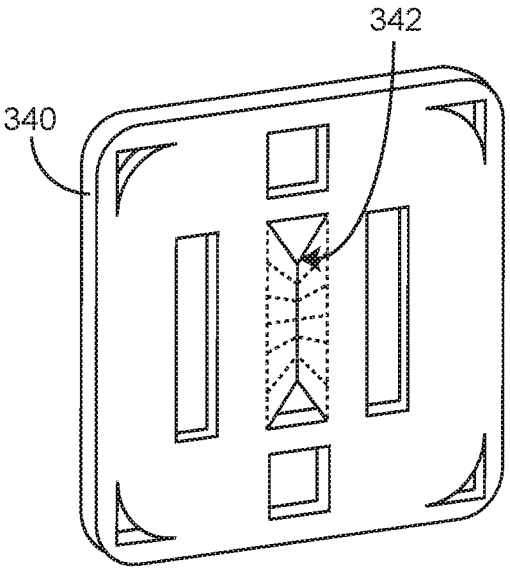

SYSTEM AND METHOD FOR ALIGNING AND LEVELING TILE

CROSS-REFERENCE TO RELATED APPLICATION

This application is a continuation of the non-provisional patent application filed on Sep. 26, 2016, and having Ser. No. 15/275,958; which application is a continuation of the non-provisional patent application filed on Feb. 21, 2014, and having Ser. No. 14/186,729, now Issued U.S. Pat. No. 9,945,133 issued Apr. 17, 2018; which patent application was a divisional of the issued patent with the issued date of Apr. 8, 2014 and having U.S. Pat. No. 8,689,521; which issued patent was a divisional of the issued patent with the issued date of Oct. 22, 2013 and having U.S. Pat. No. 8,561,370; which issued patent was a divisional of the issued patent with the issued date of Nov. 5, 2013 and having U.S. Pat. No. 8,572,927; and which issued patent was a divisional of the issued patent with the issued date of Apr. 30, 2013 and having U.S. Pat. No. 8,429,878, which patents are incorporated herein by reference in their entirety.

BACKGROUND OF THE INVENTION

This invention relates to systems and methods for laying tile and, more specifically, for efficiently reducing tile lippage. Throughout this description, the term tile is used as an example of various matter which is arranged disposed adjacent a substrate (which can be horizontal—floors or vertical—walls or other) in multiple pieces, the term tile should be understood to include panels, sheets, boards, paving stones, bricks or the like. The present invention relates more specifically to improved methods and systems which use tab systems to align and level tiles.

U.S. Pat. No. 7,861,487 and U.S. Design Pat. D63077 and the web site www.tuscanleveling.com describe a system for aligning and leveling tiles. While such systems have enjoyed some success in the past, they do have drawbacks. At the conclusion of each job, the vertical shafts extending upwardly between the tile joints in such design are broken away from the base and discarded. This generates waste that may be disposed in landfills. In addition, the act of breaking away the shaft from the base can be time consuming, and it can disturb the tiles if it is not done properly or if the tile is not sufficiently adhering to desired substrate.

Consequently, there is a need for improvement in tile aligning and leveling systems and methods.

SUMMARY OF THE INVENTION

More specifically, an object of the invention is to provide a cost effective tile aligning system.

It is a feature of the present invention to include reusable connecting tabs or shafts.

It is an advantage of the present invention to decrease the materials that are consumed or disposed of for each job.

It is another feature of the invention to include a cap system that is detachable from the tab or shaft, while it remains in place attached to the base located under the tile.

It is also an advantage of the present invention to provide improved ease of use and reduce unwanted dislocation of tiles after desired placement is accomplished.

It is another feature of the present invention to change how pressure is applied to the surface of the tile and the connecting tab.

It is another advantage of the present invention to provide for the ability to maintain lippage reducing forces over a wider range of tab or shaft elongation.

The present invention includes the above-described features and achieves the aforementioned objects.

Accordingly, the present invention comprises a tile leveling system with a reusable connecting tab; a cap which is easily removable from an attached connecting tab or shaft; or a spring like cap which provides for variable forces between the cap and the tile without any change in the separation between base and the tile.

BRIEF DESCRIPTION OF THE DRAWINGS

In the following description of the drawings, in which like reference numerals are employed to indicate like parts in the various views:

FIG. 5 shows a perspective exploded view of the tab and base combination of the present invention, where the dotted lines show underlying structure which would otherwise not be visible.

FIG. 6 shows a cross section exploded view of the tab and base combination of FIG. 5.

DETAILED DESCRIPTION OF THE DRAWINGS

Figure 1:
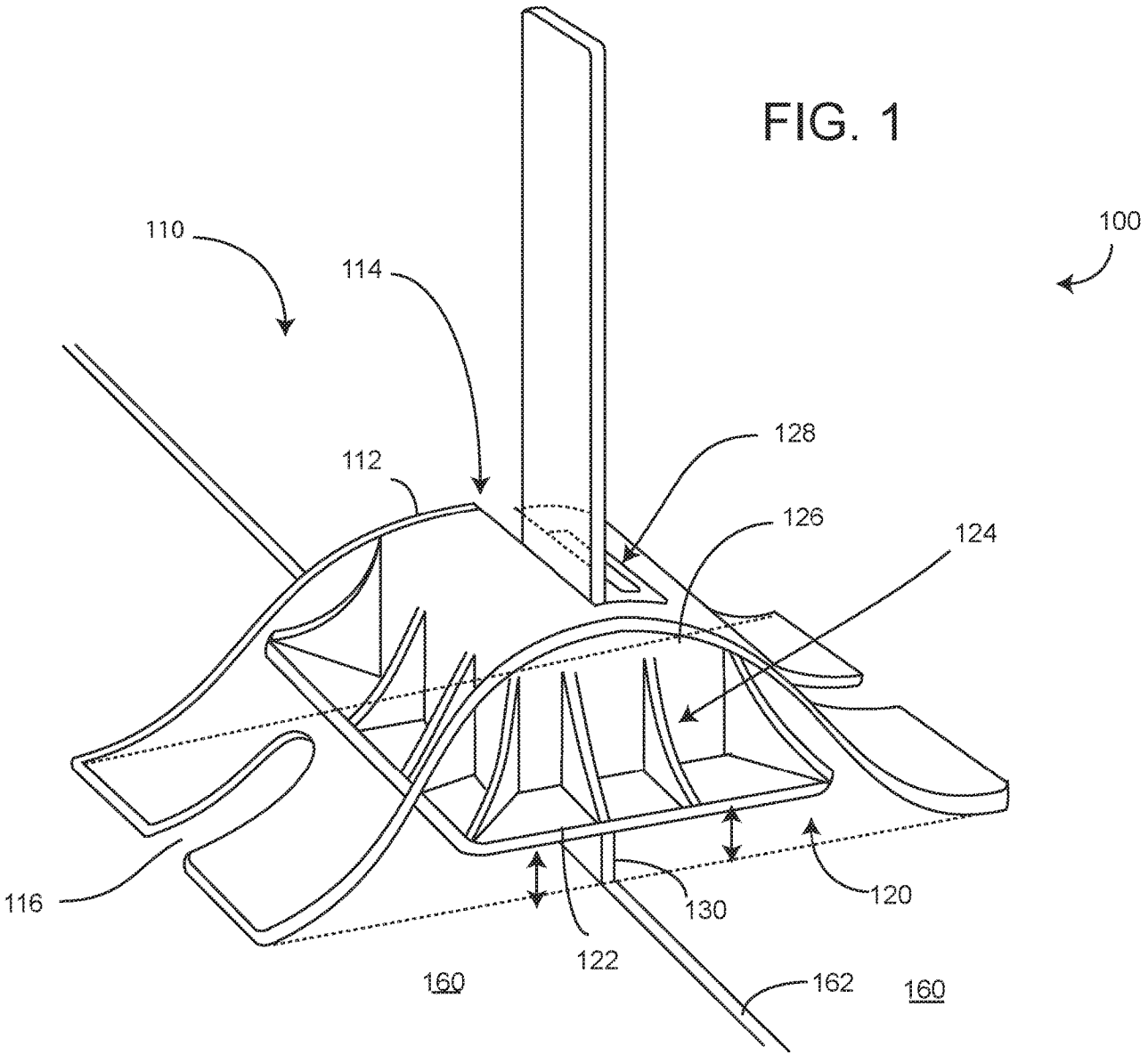
FIG. 1 is a perspective, partially transparent, view of the tile alignment and leveling system of the present invention, in its intended environment when a relatively low pressure is applied.
Figure 2:
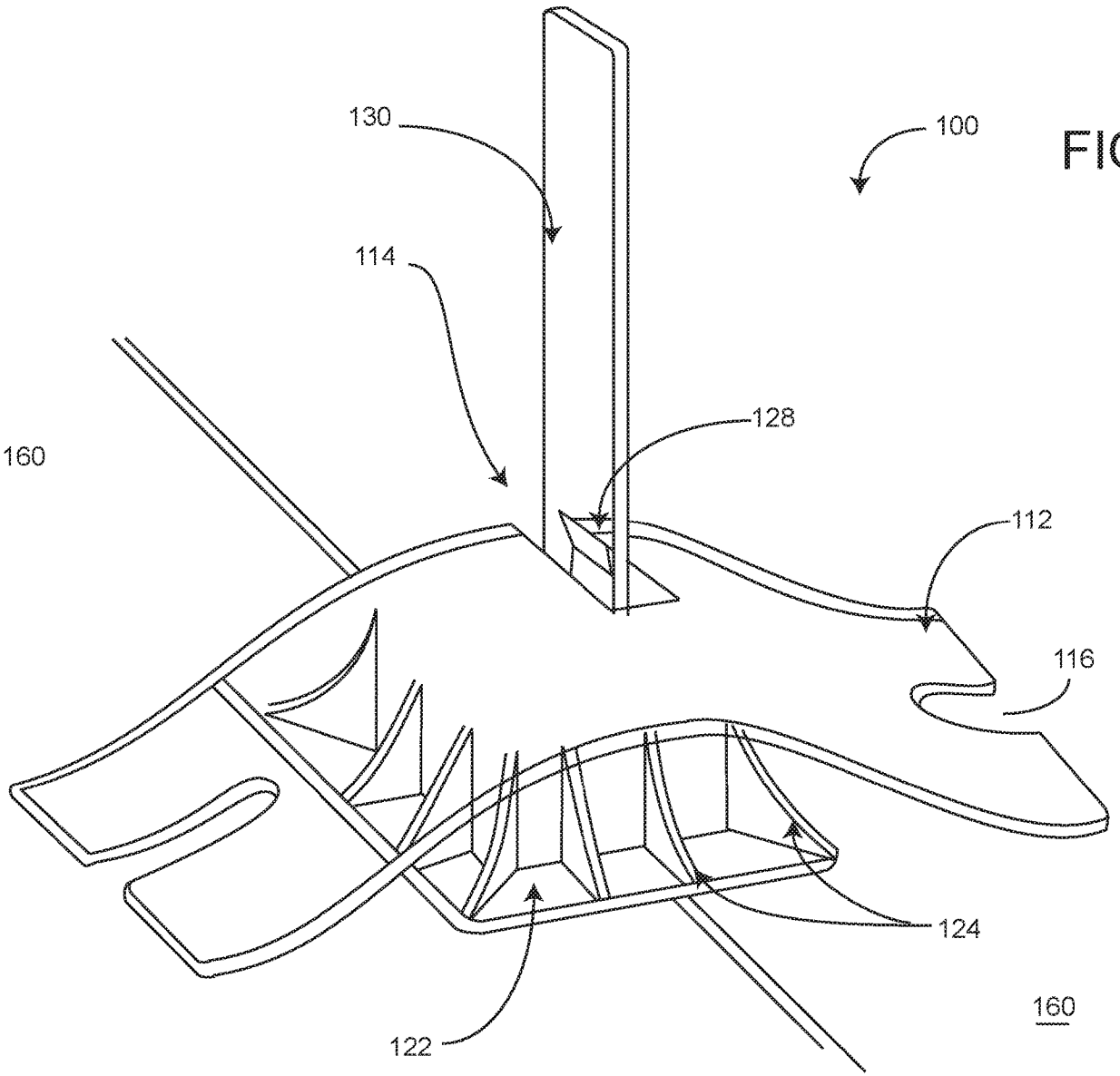
FIG. 2 is a perspective, partially transparent, view of the tile alignment and leveling system of FIG. 1, when a relatively higher pressure is applied.
Figure 3:
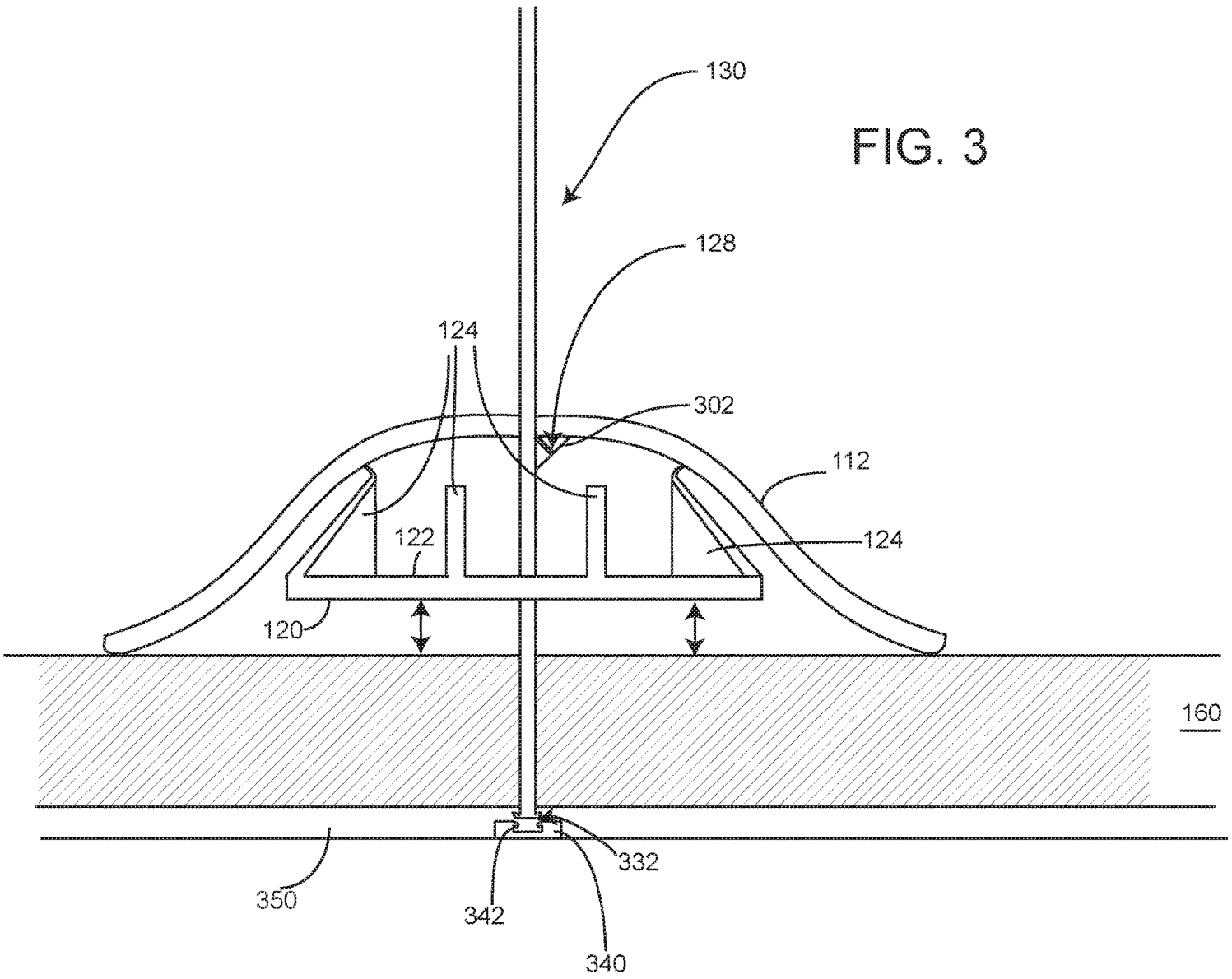
FIG. 3 shows a cross-sectional view of portions of the system as shown in FIG. 1.

Referring now to the drawings, where like numerals refer to like matter throughout, and more particularly to FIG. 1, there is shown a tile alignment and leveling system 100 which generally includes a cap system 110 and an intermediate member or connecting tab 130 which is disposed on the finished side of an array of tiles or adjacent structures 160, with a joint 162 therebetween. Cap system 110 is shown having an upper cap spring-like portion 112 and a cap base portion 120. These may be a single piece or multiple pieces of the same or dissimilar material. Upper cap spring-like portion 112 needs to be resilient so as to act like a spring when compressed, downward toward the tile. Note that upper cap spring-like portion 112 is shown in FIGS. 1 and 2 as being partially transparent so that the details of cap base portion 120 can be seen. Cap base portion 120 need not be as resilient but maybe if so desired. Cap system 110 and connecting tab 130 may be made of similar materials as prior art systems such as described in the above referenced patent. However, connecting tab 130 may be made of metal or plastic or rubber coated metal. Upper cap spring-like portion 112 includes an innovative edge tab removal slot 114 which allows for separation of the connecting tab 130 from the cap system 110 while the connecting tab 130 remains coupled to the first side member, back side member or sub tile base member 340 (FIG. 3). When cap system 110 is moved away, (e.g. slid in one direction) the connecting tab 130 passes through the edge tab removal slot 114 and detachment occurs while connecting tab 130 remains in place. Note this can occur in the configuration of FIG. 1 or FIG. 2. It is not necessary to tip the cap system 110 and thereby increase the pressure at the pivot point and increase the potential for unwanted and potentially disruptive forces on the tile. Cap system 110 can be merely slid out of the way and the connecting tab 130 then can be detached without increasing any pressure on the top surface of the tile. Upper cap spring-like portion 112 also has an optional slot 116. Disposed underneath the upper cap spring-like portion 112 is cap base portion 120 which provides increased surface area for contact between the cap system 110 and the tile. Cap base buttress 124 provides support for the cap base portion core 126 which is located centrally in cap base portion 120. Also located in cap system 110 is gripping tongue 128 which is configured to firmly grip the connecting tab 130. Note that connecting tab 130 does not necessarily require that there be surface features thereon in order to properly function.

One advantage of the present invention over the system of the above referenced patent is that the upper cap spring-like portion 112 acts like a spring which can provide a force which tends to hold adjacent tile in the same relative position, despite a stretching or thermal expansion of said connecting tab 130. Note, in the above referenced patent, if the shaft were to become elongated (even in some cases by a very small amount) as a result of stretching or thermal expansion; then the force applied by the cap onto the adjacent tiles could be completely eliminated. The spring-like nature of the upper cap spring-like portion 112 makes it much less likely that enough elongation will occur to eliminate contact. In other words, it is not as likely that the elongation will be sufficient to overcome the amount of deflection of the upper cap spring-like portion 112.

Now referring to FIG. 2, there is shown a tile alignment and leveling system 100 of FIG. 1 which has been pressed downward so that the cap base flange 122 now touches the tile top surface. It can be seen that the contact surface between the cap system 110 and the tile includes both the points of contact between the upper cap spring-like portion 112 and the cap base flange 122. This area of contact can be several times the area of similar contact in the above described patent.

Now referring to FIG. 3, there is shown the cross-sectional view of the tile alignment and leveling system 100 of FIG. 1. Also shown is gripping tongue support member 302 which is shown as being coupled to the upper cap spring-like portion 112. Note, that when upper cap spring-like portion 112 is pressed downward as in FIGS. 2 and 4 there is deflection of upper cap spring-like portion 112 and therefor relative movement of gripping tongue support member 302/gripping tongue 128 mounted thereon with respect to the connecting tab 130. Also shown in FIG. 3 is the substrate mortar 350 and sub tile base member 340 which is placed in the mortar or against the substrate. Sub tile base member 340 is shown having base mating portion 342 for temporarily grasping the connecting tab base mating member 332 disposed on connecting tab 130. Note, that the base mating portion 342 is designed to release the connecting tab base mating member 332 or otherwise disengage contact with the connecting tab 130 when a requisite force or series of forces is applied thereto. In one embodiment, connecting tab base mating member 332 is a portion of a reusable connecting tab that is removed from the sub tile base member 340 on one job and used again and again on other jobs. In such a configuration only the sub tile base member 340 is a consumable or non-reusable portion of the system. Note: connecting tab base mating member 332 is shown in an enlarged or exaggerated manner for clarity in FIGS. 3 and 4. FIGS. 5 and 6 show embodiments where the widest portion of connecting tab base mating member 332 is not any wider than the widest portion of the remainder of connecting tab 130, this allows for removal of the connecting tab 130 with connecting tab base mating member 332 through the joint in the tile without the need to remove any additional mortar.

Figure 4:
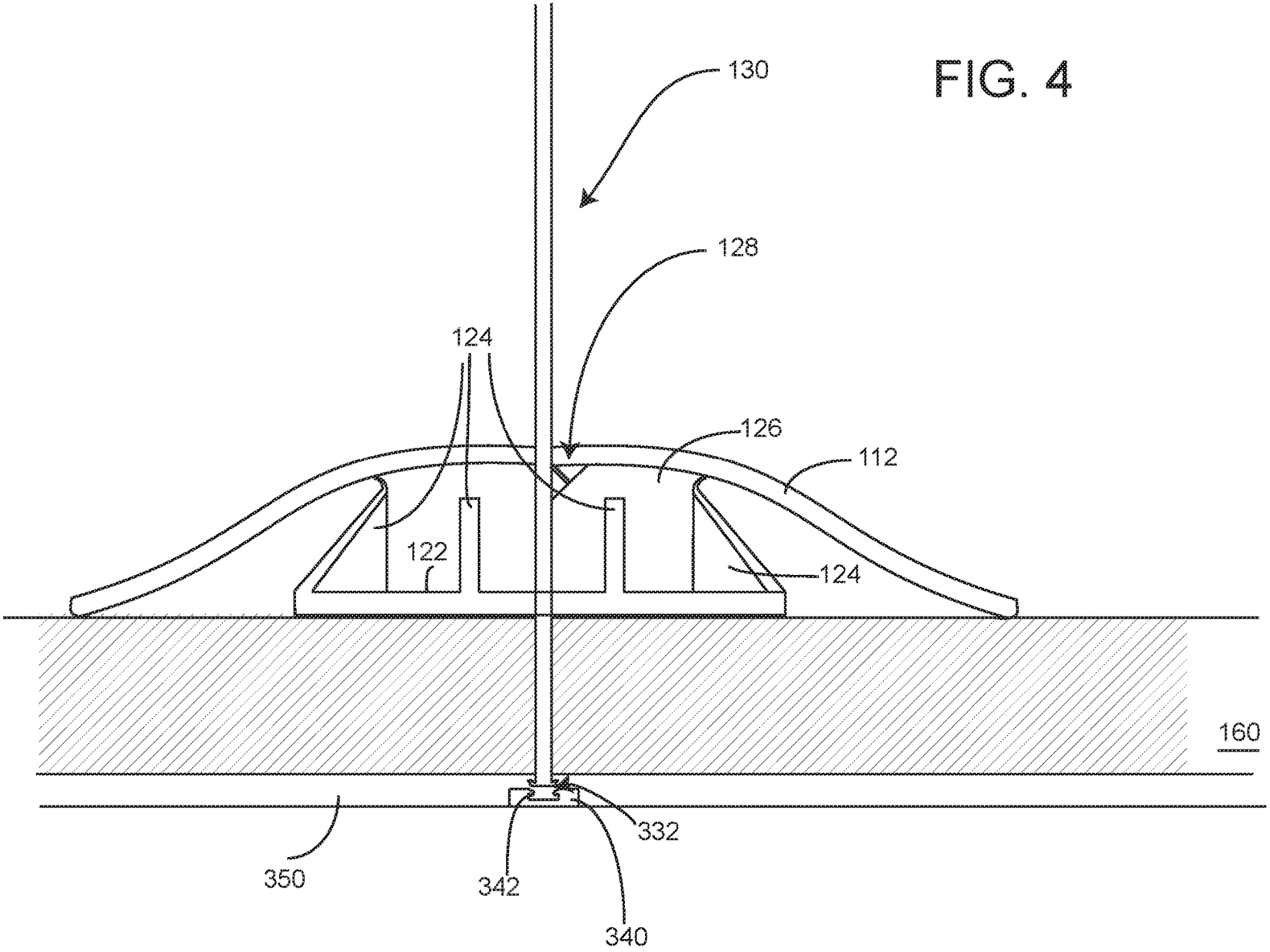
FIG. 4 shows a cross-sectional view of portions of the system as shown in FIG. 2.

Now referring to FIG. 4, there is shown a cross-sectional representation of the tile alignment and leveling system 100 of FIG. 2, which shows the cap base portion 120 touching the tile 160 and the upper cap spring-like portion 112 spread out further. After the initial contact between cap base flange 122 and tile 160 is fully made, the upper cap spring-like portion 112 is configured to apply a variable force between the cap base flange 122 and tile 160 by deflection of the upper cap spring-like portion 112 and without and movement of the cap base portion 120 or the tile 160.

Now referring to FIG. 5, there is shown an exploded perspective view of the connecting tab 130 and sub tile base member 340 combination of the present invention. Sub tile base member 340 is shown having base mating portion 342 which is designed to temporarily grip connecting tab base mating member 332 and then release when the requisite forces are applied. Connecting tab 130 is shown having a connecting tab base mating member 332 which may be a separate metal piece inserted into a connecting tab end opening 504 so that connecting tab mating member internal gripping teeth 502 (shown in dotted lines) hold the connecting tab base mating member 332 in place with respect to the connecting tab 130.

Now referring to FIG. 6, there is shown an exploded cross-sectional view of the connecting tab 130 and sub tile base member 340 combination of the present invention.

In operation, the system of the present invention utilizes the following method:

The reusable connecting tab 130 is coupled to the sub tile base member 340. The system is used to align and level tile in a manner similar to the system described in the above referenced patent, except for the flexing of upper cap spring-like portion 112 after the cap base flange 122 contacts the tile.

In the present invention the upper cap spring-like portion 112 may be, but is not necessarily, compressed and deflected when pressed toward the tile 160. This additional compression of cap system 110 after contact between the cap base flange 122 and the tile provides the force retaining feature to avoid problems associated with undesired elongation of the connecting tab 130.

At the desired time, (e.g. after the mortar is set) the cap system 110 can be removed from the surface of the tile 160 without tipping the cap system 110 and temporarily increasing the forces between the cap and the tile. Instead, the cap system 110 is merely slid away from the connecting tab 130 while the connecting tab 130 remains coupled to the sub tile base member 340. After the cap system 110 has been separated from the connecting tab 130, the re-usable connecting tab 130 is removed from the sub tile base member 340 without the need for increasing downward pressure on portions of the top surface of the tile 160.

The process is repeated for all of the connecting tab 130 and cap system 110 combinations utilized for the job and the re-useable connecting tabs 130 are cleaned and stored for future re-use.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

I claim:

1. A tile alignment system comprising:

mortar and a first side member, configured to be placed on a first side of a plurality of adjacent structures;

a connecting tab operatively coupled with said first side member and sized with a thickness dimension and a width dimension so as to extend through a joint existing between two of said plurality of adjacent structures;

said connecting tab further operatively coupled with matter configured to facilitate pressure to a second side of said plurality of adjacent structures, where said second side is opposite said first side; said pressure assists in reducing misalignment between said plurality of adjacent structures;

said first side member configured with a void in an upper portion for cooperation with lower portion of said connecting tab;

said upper portion disposed within and movable with respect to said void and is configured to provide a force resisting separation therefrom of said lower portion; and said upper portion, is configured to separate from said lower portion.

2. The system of claim 1 wherein said upper portion when a removal force is applied thereto, is configured to deform and thereby change an orientation with respect to said lower portion so as to reduce said force resisting removal of said mating member.

3. The system of claim 2 wherein said first side member is a non-reusable sub-tile base member.

4. The system of claim 2 wherein said thickness dimension is less than a shortest distance across said joint and said width dimension is larger than said shortest distance across said joint.

5. The system of claim 4 wherein said force resisting removal is reduced more when said removal force is increased.

6. The system of claim 4 wherein said removal force is provided by pulling along a longitudinal axis of said connecting tab.

7. A tile alignment system comprising:

intermediate member for transmitting a force between a back side of a plurality of adjacent tiles and a portion of a front side, which is an opposite side from said back side;

mortar and a back side member which is configured to be placed on said back side of said plurality of adjacent tiles; and said back side member including a portion configured to cooperate with said intermediate member and to reduce forces resisting removal of said intermediate member when forces aligned with a longitudinal axis of said intermediate member are applied.

8. The system of claim 7 wherein said portion comprises an upper portion configured to cooperate with a lower portion of said intermediate member.

9. The system of claim 8 wherein said intermediate member is coupled to a front side member.

10. The system of claim 9 wherein said intermediate member provides a portion of a direct physical connection between said back side and said front side.

11. The system of claim 7 wherein said front side member is configured to slide down the intermediate member until contact with said plurality of adjacent tiles is made.

12. A tile alignment system comprising:

mortar;

a back side member which is configured to be placed, in said mortar, on a back side of a plurality of adjacent slabs;

an intermediate member including a bottom portion; and said back side member have a portion thereof which is a means, operable and movable with respect to said back side member, for releasing said intermediate member.

13. The system of claim 12 wherein said means for releasing said intermediate member comprises a lowest portion operatively coupled with said back side member.

14. The system of claim 13 wherein said means for releasing further comprises a mating portion in said back side member.

15. The system of claim 12 wherein said means for releasing comprises matter disposed in said back side member which is configured to resist and then permit separation from said lowest portion of said intermediate member.

16. The system of claim 15 wherein said intermediate member is a connecting tab and is configured to be pulled out of engagement with said back side member.

17. The system of claim 12 wherein a releasing of said intermediate member is an effect of a force being applied to said back side member.

18. The system of claim 17 wherein said effect is a releasing of a force resisting removal of said intermediate member.

19. The system of claim 18 wherein the effect is increased as said releasing force is increased.

20. The system of claim 19 wherein said releasing force is aligned with a longitudinal axis of said intermediate member.

* * * * *